US007008195B2

(12) United States Patent
McGrath et al.

(10) Patent No.: US 7,008,195 B2
(45) Date of Patent: Mar. 7, 2006

(54) COMPRESSOR SPRING LOCATOR

(75) Inventors: Stephen Michael McGrath, Hampshire (GB); Michael Chalton McGrath, Hampshire (GB)

(73) Assignee: Archfact Limited, Waterlooville (GB)

( * ) Notice: Subject to any disclaimer, the term of this patent is extended or adjusted under 35 U.S.C. 154(b) by 200 days.

(21) Appl. No.: 10/221,004

(22) PCT Filed: Mar. 9, 2001

(86) PCT No.: PCT/GB01/01014

§ 371 (c)(1),
(2), (4) Date: Dec. 9, 2002

(87) PCT Pub. No.: WO01/69084

PCT Pub. Date: Sep. 20, 2001

(65) Prior Publication Data

US 2003/0183794 A1 Oct. 2, 2003

(30) Foreign Application Priority Data

Mar. 11, 2000 (GB) ..... 0005825

(51) Int. Cl.
*F04C 15/00* (2006.01)

(52) U.S. Cl. ..... 417/417; 251/337

(58) Field of Classification Search ..... 251/337; 267/170, 179; 417/415, 416, 417
See application file for complete search history.

(56) References Cited

U.S. PATENT DOCUMENTS 4,090,816 A 5/1978 Takahashi
4,718,832 A * 1/1988 Takahashi ..... 417/417
4,721,440 A * 1/1988 Hurst ..... 417/417
4,854,833 A 8/1989 Kikuchi et al.
5,100,304 A 3/1992 Osada et al.
5,454,150 A * 10/1995 Hinke et al. ..... 267/170
5,597,294 A * 1/1997 McGrath ..... 417/417
5,603,612 A * 2/1997 McGrath ..... 417/417
5,727,932 A * 3/1998 McGrath ..... 417/417

FOREIGN PATENT DOCUMENTS

DE 199 00 886 A1 7/1999
DE 199 22 511 A1 11/1999
EP 0 770 779 A2 5/1997

* cited by examiner

*Primary Examiner*—Eric Keasel
(74) *Attorney, Agent, or Firm*—Christensen O'Connor Johnson Kindness PLLC

(57) ABSTRACT

A spring locating body (36) is a substantially annular shape formed with an annular recess (38) and a radially inner circular hole (40) that extends through the spring locating body (36). The spring locating body (36) is a substantially rigid plastically deformable material such as nylon. Extending radially outwardly from the spring locating body (36) are four limbs (42). The limbs (42) are equally spaced around the spring locating body (36) at intervals of 90°. Extending away from the rear surfaces of each limb (42) is a deformable rib (44). Each rib (44) extends across the respective limbs (42) in an arc about the central axis (46) of the spring locating body (36). The ribs (44) have a triangular cross-section the apex of which is distant from the limb (42). Alternatively, the ribs (44) can be in the form of a plurality of cone shaped nibs extending in a direction away from the surface of the respective limbs (42).

27 Claims, 3 Drawing Sheets

Figure 4
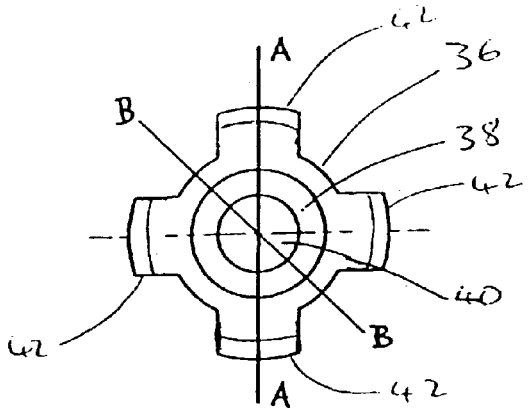
Figure 5
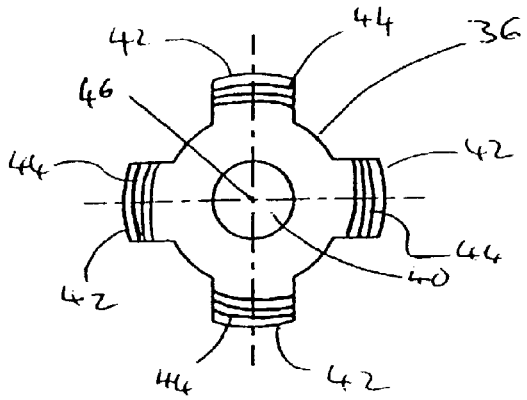
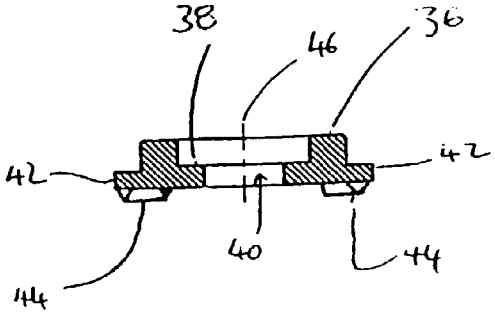
Figure 6
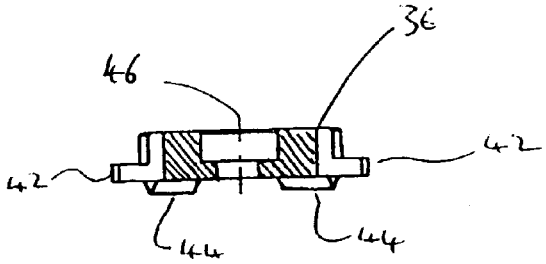
Figure 7

COMPRESSOR SPRING LOCATOR

This is a United States national stage application of International application No. PCT/GB01/01014, filed Mar. 9, 2001, the benefit of the filing date of which is hereby claimed under 35 U.S.C. § 120, which in turn claims the benefit of United Kingdom application No. 0005825.5, filed Mar. 11, 2000, the benefit of the filing date of which is hereby claimed under 35 U.S.C. § 119.

The present invention relates to means for locating a spring within a compressor and a method for locating a spring within a compressor and is concerned particularly, although not exclusively, with a spring locator device and a method for locating a spring within an electromagnetic reciprocating compressor or pump for transferring gases such as air.

Existing electromagnetic compressors have a reciprocating piston assembly formed with an armature and a piston guide. Such electromagnetic reciprocating compressors can act as positive pressure pumps and/or as vacuum pumps, but the term compressor will be used generally hereafter to describe both a positive pressure pump and a vacuum pump. The piston assembly is moved due to an electromagnetic field generated by an electrical coil. Such compressors comprise a piston assembly of multiple parts including a piston head bolted to the end of a spacer part. The opposite end of the spacer part is formed with an armature and a rear guide piston. In use the piston head reciprocates within a cylinder and the rear guide piston reciprocates within a cylindrical piston guide. The return stroke of the piston assembly is produced by a spring axially aligned within the rear guide piston.

An example of this type of compressor is described in patent specification EP 0770779B. In this example the compressor comprises two compression springs of opposite helical coiling that are arranged axially aligned with each other. The outer ends of the respective springs are each received on an axial spigot. One axial spigot is formed on the piston guide and the second spigot is formed on a spring support. The spring support is resiliently held against a rear piston guide by a rubber compression body and an end plate.

The springs that are disclosed in the patent specification EP 0770779B are 'open-ended springs'. Hence, only a small portion of the end coil of the first spring is in contact with the piston guide and only a small portion of the end coil of the second spring is in contact with the spring support.

The various engaging parts of the compressor have to be manufactured to within high tolerances. The lamination tolerances may be compounded and adversely affect the position of the cylindrical piston guide.

The axial location of the piston assembly is important in order to help reduce excessive wear and excessive noise produced during the use of the compressor.

According to a first aspect of the present invention there is provided a spring locating body for an electromagnetic reciprocating compressor, the spring locating body comprising spring location means, tolerance adjustment means and fluid communication means.

Preferably, the spring location means works on the principle of preventing the axial movement of more than one end coil of a spring that is in contact with a supporting surface, the arrangement being such that, in use, the coils of the spring having axial movement relative to the respective supporting surfaces of the spring are distant from the supporting surface.

Preferably, the tolerance adjustment means comprises the spring locating body comprising a region that is capable of being deformed due to the clamping action between an end of a guide sleeve and an end portion of the spring locating body.

Preferably, the fluid communication means comprises one or more channels extending through the spring locating body.

According to a second aspect of the present invention there is provided an electromagnetic reciprocating compressor comprising a body formed with a cylinder, a compressor piston assembly, a spring and means for locating the ends of the spring, the arrangement being such that in use the compressor piston assembly reciprocates within the cylinder and more than one of the coils of the spring are without axial movement during the reciprocation of the piston assembly.

An end coil of the spring is preferably a closed-end turn.

Preferably the end coil of the spring is a ground closed-end turn.

Preferably the means for locating the ends of the spring comprises a substantially flat supporting surface and the ground closed-end turn is in contact with the substantially flat supporting surface.

The end of the spring is preferably a double closed pitch ground closed end turn.

In a first embodiment of the invention the means for locating the ends of the spring comprises a substantially flat supporting surface formed within a recess, the arrangement being such that the end of the spring is received within the recess.

The recess preferably has a substantially circular cross-section.

Preferably, the end of the spring is held within the substantially circular recess.

The depth of the circular recess is preferably less than the depth of the double closed pitch ground closed end turn of the coil.

Preferably, two separate and opposite ends of the spring are without axial movement with respect to their respective supporting surfaces during reciprocation of the compressor piston assembly.

It is preferable that the two separate and opposite ends of the spring are each double closed pitch ground closed end turns and each end is in contact with a respective substantially flat supporting surface formed with respective circular recesses.

Preferably, one end of the spring is received by a circular recess formed in an end portion of the body.

Preferably, the opposite end of the spring is received by a circular recess formed in the piston assembly.

In a second embodiment of the invention the means for locating the ends of the spring comprises a substantially flat supporting surface disposed around a spigot portion that extends in a direction away from the flat supporting surface.

An end potion of the spring of the spring is preferably placed on the spigot portion, the arrangement being such that in use the end portion of the spring does not axially move with respect to the spigot portion during the reciprocation of the piston assembly.

According to a third aspect of the present invention there is provided a method for locating a spring within a compressor, the method comprising preventing the axial movement of more than one of the coils of an end of the spring that is in contact with a supporting surface, the arrangement being such that, in use, the coils of the spring that move axially relative to the supporting surface of the spring are distant from the supporting surface.

Preferably the spring is formed with two ends that are each formed with more than one closed pitch turn, each end being located within two separate substantially circular recesses, the arrangement being such that in use the coils of the spring that have axial movement are distant from the respective supporting surfaces.

According to a fourth aspect of the present invention there is provided an electromagnetic reciprocating compressor comprising a body formed with a cylinder, a compressor piston assembly, a spring, and spring locating device, the arrangement being such that in use the piston compressor assembly reciprocates within the cylinder and at least one end coil of the spring is without axial movement during reciprocation of the piston assembly.

Preferably, the spring locating device is formed with a substantially circular recess suitable for receiving at least one end coil of the spring.

The spring locating device is preferably a substantially annular shaped spring support body.

Preferably, the compressor piston assembly comprises a compression piston, located within the cylinder, a guide element attached to the compression piston and axially spaced from the compression piston, and a guide sleeve within which the guide element is in slidable contact, the arrangement being such that the spring locating device is substantially rigidly clamped between an end of the guide element and an end portion of the body.

The spring locating device preferably comprises a region that is capable of being deformed due to the clamping action between the end of the guide sleeve and the end portion of the body.

Preferably the spring locating device comprises venting means.

Preferably, the substantially annular spring locating device comprises a number of radially extending limb sections that define the venting means.

The annular spring locating device preferably comprises four radially extending limb sections spaced at intervals of 90 degrees around the annular spring locating device.

Preferably, each limb section is formed with a region that is capable of being deformed due to the clamping action between the end of the guide sleeve and the end portion of the body.

The regions that are capable of being deformed due to the clamping action between the end of the guide sleeve and the end portion of the body are preferably ribs that extend across the respective surfaces of the limb sections.

Alternatively, the regions that are capable of being deformed due to the clamping action between the end of the guide sleeve and the end portion of the body are in the form of raised nibs.

Preferably the raised nibs are a conical shape.

The ribs preferably comprise a substantially triangular cross section.

In a further alternative the spring locating device preferably comprises a region that is capable of being deformed due to the clamping action between the end of the guide sleeve and the end portion of the body, the arrangement being such that a portion is pushed into said region during the clamping of the assembly.

According to a fifth aspect of the present invention there is provided a method of assembling an electromagnetic reciprocating compressor comprising a body formed with a cylinder, a compressor piston assembly having a cylindrical piston guide, a spring, and a spring locating body comprising a deformable region, the method comprising clamping the spring locating body between an end section of the body and the cylindrical piston guide such that a part of the deformable region is permanently deformed.

We have discovered that there are disadvantages with existing spring supports due to the fact that only a small portion of the end coil of an open-ended spring, or a single closed-ended spring, is in contact with the spring support and spigot. When the spring is compressed a part of the end coil slides against the spigot. One or more of the coil turns tend to clip the edge of spigot when the spring is compressed. This clipping action can affect the axial alignment of the piston assembly and also generate dust particles. The clipping action also generates unwanted vibrations in the reciprocating piston assembly. The part of the coil sliding against the spigot can increase wear and generate abrasive dust. If the height of the spigot is decreased in order to try to reduce the amount of wear, the spring tends to become disconnected from the spigot.

The axial alignment can also be affected by the fact that only a small portion of the end coil of the open-ended spring is in contact with the spring support.

There may be particular advantages to combining the features of the various aspects of the present invention and the invention may include any combination of the features or limitations referred to herein.

The present invention may be carried into practice in various ways, but an embodiment will now be described, by way of example only, with reference to the accompanying drawings in which:

FIG. 4 is a plan view of the spring support body shown in FIG. 1;

FIG. 5 is a base view of the spring support body shown in FIG. 1;

FIG. 6 is a cross sectional view through A—A of the spring support body shown in FIG. 4; and FIG. 7 is a cross sectional view through B—B of the spring support body shown in FIG. 4.

Figure 1:
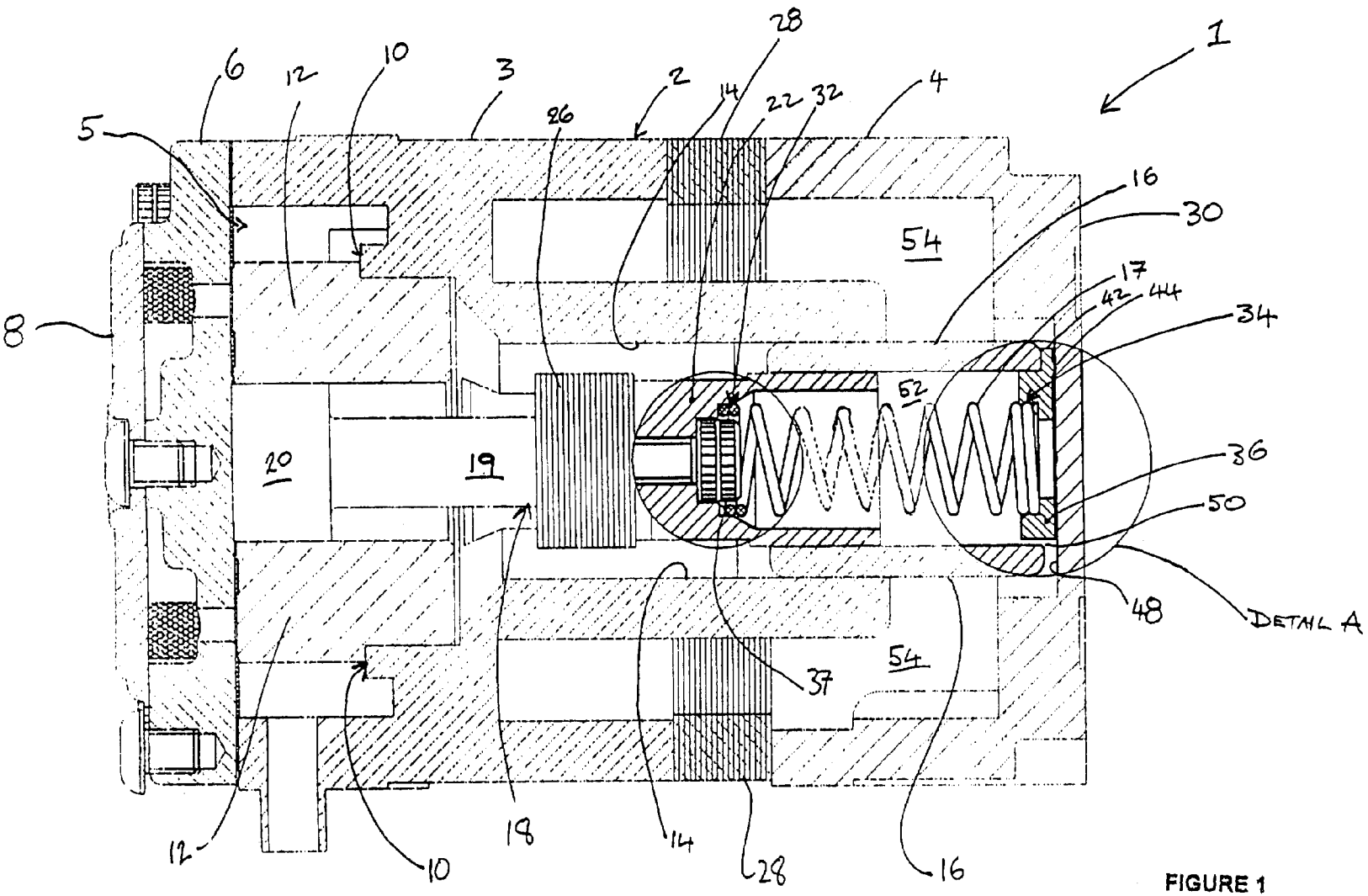
FIG. 1 is an axial cross-sectional side view of an electromagnetic reciprocating compressor.
Figure 2:
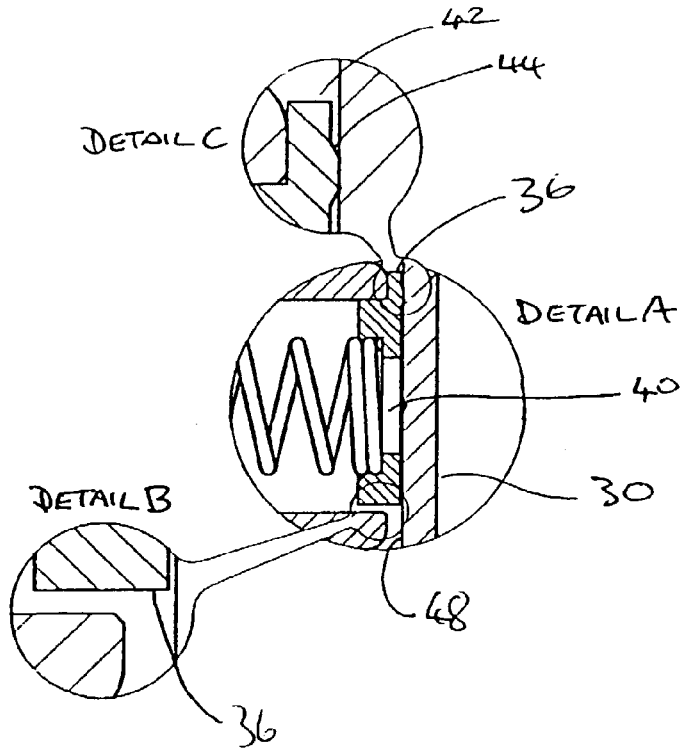
FIG. 2 shows more detailed views B and C of detail A shown in FIG. 1.

Referring to FIG. 1, a compressor 1 includes a main body 2 comprising a front body part 3 and a rear body part 4. The main body 2 has a generally square cross-section. The front body part 3 is bolted to the rear body part 4. The main body 2 is formed with a main opening 5 at one end of the front body part 3. Bolted to the front body part 3 at the main opening 5 is a cylinder head 6. Bolted to the cylinder head 6 is a cover plate 8. The main body 2 is formed with an internal machined surface region 10 adapted to receive a substantially cylindrical compression cylinder body 12. The main body 2 is also formed with a second internal stepped surface region 14 that receives a cylindrical piston guide 16.

Disposed within the main body 2 is a piston assembly 18 that comprises a compression piston head 20 at one end of the piston assembly 18. The compression piston head 20 is connected via a piston shaft 19 to a guide piston 22 at the opposite end of the piston assembly 18.

The piston assembly 18 is axially reciprocatingly movable within the main body 2. The compression piston head 20 is in slidable contact with the cylinder body 12 and the guide piston 22 is in slidable contact with the piston guide 16.

The piston assembly 18 carries an armature 26 and electromagnetic coils (not shown). The piston assembly 18 moves in one direction as the armature 26 is driven linearly by the laminate stator 28 and the coils and is moved linearly in an opposing direction by a spring 17 in a well known manner. The reciprocation of the piston assembly 18 is well known to the skilled addressee and therefore further details of the arrangement will not be described.

The axial alignment of the piston assembly 18 is important in order to help reduce excessive wear and excessive noise produce during the use of the compressor 1.

Disposed within the piston guide 16 is the spring 17. The rear body part 4 includes an enclosing end portion 30. The spring 17 comprises a first end 32 and a corresponding second end 34. The ends 32, 34 of the spring 17 each comprise double close pitch ground closed end turns. A spring locating body 36 receives the second end turn 34. An annular recess 37 formed in the radially inner portion of the guide piston 22 receives the first closed-end 32.

Referring to FIGS. 2 and 4 to 6, the spring locating body 36 is a substantially annular shape formed with an annular recess 38 and a radially inner circular hole 40 that extends through the spring locating body 36. The spring locating body 36 is a substantially rigid plastically deformable material such as nylon. Extending radially outwardly from the spring locating body 36 are four limbs 42. The limbs 42 are equally spaced around the spring locating body 36 at intervals of 90°. Extending away from the rear surfaces of each limb 42 is a deformable rib 44. Each rib 44 extends across the respective limbs 42 in an arc about the central axis 46 of the spring locating body 36 The ribs 44 have a triangular cross-section the apex of which is distant from the limb 42. Alternatively, the ribs 44 can be in the form of a plurality of cone shaped nibs extending in a direction away from the surface of the respective limbs 42.

In an alternative embodiment (not shown) the spring locating body may comprise a central spigot similar to known spring locating devices in place of the annular recess 38. The spigot is receivable by the radially inner region of the spring 17. The radially outermost surface of the spigot is in contact with the radially innermost surface of the end coils of the spring 17.

In the assembled state the spring locating body 36 is secured between the end of the cylindrical piston guide 16 and the internal surface 48 of the enclosing end portion 30. The other end of the piston guide 16 abuts the laminate stator 28. As the assembly is tightened together the ribs 44 are forced against the internal surface 48 and can deform to take account of the tolerances of the individual components of the assembly. The deformation of one or more of the ribs 44 helps to position the piston assembly 18 correctly.

The skilled addressee will appreciate that any suitable shape can be used for the deformable ribs and the shape may depend on the type of compressor.

In an alternative arrangement the innermost surface 48 of the enclosing end portion 30 is formed with a plurality of non-deformable ribs (not shown). As the assembly is tightened the non-deformable ribs are pushed into the deformable surface of the spring locating body. The spring locating body can deform to take account of the tolerances of the individual components of the assembly.

The four spaces between the limbs 42 act as venting ducts 50 to allow gases to pass between the radially inner region 52 of the piston guide 16 and a radially outer duct region 54 of the rear body part 4.

In use when the guide piston 22 reciprocates within the piston guide 16 the closed-end coils 34 of the spring 17 do not axially move with respect to the support body 36 and the closed-end coils 32 do not axially move with respect to the annular recess 37.

Figure 3:
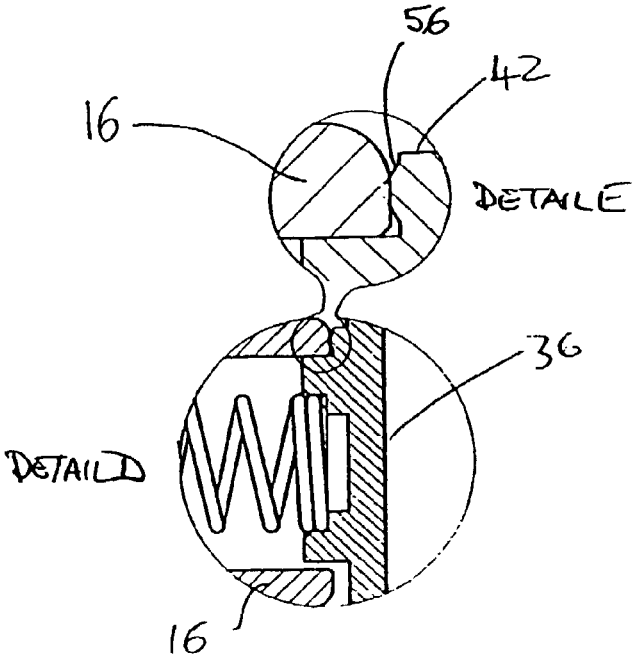
FIG. 3 shows a more detailed view E of an alternative detail D of detailed view A shown in FIG. 1.

Referring to FIG. 3, there is shown a further embodiment of the spring locating body 36. In this embodiment the axially opposite surface of the limbs 42 are formed with deformable ribs 56, the arrangement being such that in the assembled state the ribs 56 abut the end surface of the cylindrical piston guide 16.

What is claimed is:

1. An electromagnetic reciprocating compressor comprising a body formed with a cylinder, a compressor piston assembly, a spring having two separate and opposite ends, and means for locating the ends of the spring, wherein the compressor piston assembly reciprocates within the cylinder and more than one of the coils of the spring are without axial movement during the reciprocation of the compressor piston assembly, the electromagnetic reciprocating compressor further comprising a region that permanently deforms in use due to clamping action between the body and the compressor piston assembly.

2. An electromagnetic reciprocating compressor as claimed in claim 1, wherein an end coil of the spring is a closed-end turn.

3. An electromagnetic reciprocating compressor as claimed in claim 2, wherein the end coil of the spring is a ground closed-end turn.

4. An electromagnetic reciprocating compressor as claimed in claim 3, wherein the end of the spring is a double closed pitch ground closed end turn.

5. An electromagnetic reciprocating compressor as claimed in claim 3, wherein the means for locating the ends of the spring comprises a substantially flat supporting surface and the ground closed-end turn is in contact with the substantially flat supporting surface.

6. An electromagnetic reciprocating compressor as claimed in claim 1, wherein the means for locating the ends of the spring comprises a substantially flat supporting surface formed within a recess, wherein one end of the spring is received within the recess.

7. An electromagnetic reciprocating compressor as claimed in claim 6, wherein the recess has a substantially circular cross-section.

8. An electromagnetic reciprocating compressor as claimed in claim 7, wherein the end of the spring is held within the substantially circular recess.

9. An electromagnetic reciprocating compressor as claimed in claim 7, wherein the end of the spring is a double closed pitch ground closed end turn and the depth of the circular recess is less than the depth of the double closed pitch ground closed end turn of the spring.

10. An electromagnetic reciprocating compressor as claimed in claim 6, wherein the two separate and opposite ends of the spring are without axial movement with respect to their respective supporting surfaces during reciprocation of the compressor piston assembly.

11. An electromagnetic reciprocating compressor as claimed in claim 10, wherein the two separate and opposite ends of the spring are each double closed pitch ground closed end turns and each end is in contact with a respective substantially flat supporting surface formed with respective circular recesses.

12. An electromagnetic reciprocating compressor as claimed in claim 10, wherein one end of the spring is received by a circular recess formed in an end portion of the body.

13. An electromagnetic reciprocating compressor as claimed in claim 12, wherein the opposite end of the spring is received by a circular recess formed in the compressor piston assembly.

14. An electromagnetic reciprocating compressor comprising a body formed with a cylinder, a compressor piston assembly, a spring, and a spring locating device, wherein the compressor piston assembly reciprocates within the cylinder and at least one end coil of the spring is without axial movement during reciprocation of the compressor piston assembly, the electromagnetic reciprocating compressor further comprising a region that permanently deforms in use due to the clamping action between the body and the compressor piston assembly.

15. An electromagnetic reciprocating compressor as claimed in claim 14, wherein the spring locating device is formed with a substantially circular recess suitable for receiving at least one end coil of the spring.

16. An electromagnetic reciprocating compressor as claimed in claim 15, wherein the spring locating device is a substantially annular shaped spring support body.

17. An electromagnetic reciprocating compressor as claimed in claim 14, wherein the compressor piston assembly comprises a compression piston, located within the cylinder, a guide element attached to the compression piston and axially spaced from the compression piston, and a guide sleeve within which the guide element is in slideable contact, wherein the spring locating device is substantially rigidly clamped between an end of the guide element and an end portion of the body.

18. An electromagnetic reciprocating compressor as claimed in claim 17, wherein the spring locating device comprises a region that is capable of being deformed due to clamping action between the guide sleeve and the end portion of the body.

19. An electromagnetic reciprocating compressor as claimed in claim 17, wherein the spring locating device comprises a region that is capable of being deformed due to the clamping action between the end of the guide sleeve and the end portion of the body, the electromagnetic reciprocating compressor being such that a portion is pushed into said region during the clamping of the assembly.

20. An electromagnetic reciprocating compressor as claimed in claim 14, wherein the spring locating device comprises venting means.

21. An electromagnetic reciprocating compressor as claimed in claim 20, wherein the substantially annular spring locating device comprises a number of radially extending limb sections that define the venting means.

22. An electromagnetic reciprocating compressor as claimed in claim 21, wherein the annular spring locating device comprises four radially extending limb sections spaced at intervals of 90 degrees around the annular spring locating device.

23. An electromagnetic reciprocating compressor as claimed in claim 22, wherein each limb section is formed with a region that is capable of being deformed due to the clamping action between the end of the guide sleeve and the end portion of the body.

24. An electromagnetic reciprocating compressor as claimed in claim 23, wherein the regions that are capable of being deformed due to the clamping action between the end of the guide sleeve and the end portion of the body are ribs that extend across the respective surfaces of the limb sections.

25. An electromagnetic reciprocating compressor as claimed in claim 23, wherein the regions that are capable of being deformed due to the clamping action between the end of the guide sleeve and the end portion of the body are in the form of raised nibs.

26. An electromagnetic reciprocating compressor as claimed in claim 25, wherein the raised nibs are a conical shape.

27. An electromagnetic reciprocating compressor as claimed in claim 25, wherein the ribs comprise a substantially triangular cross section.

* * * * *